US009156527B2

(12) United States Patent
Camardelle

(10) Patent No.: US 9,156,527 B2
(45) Date of Patent: Oct. 13, 2015

(54) TELESCOPING ANCHOR PIN

(71) Applicant: Louis Peter Camardelle, Marrero, LA (US)

(72) Inventor: Louis Peter Camardelle, Marrero, LA (US)

( * ) Notice: Subject to any disclaimer, the term of this patent is extended or adjusted under 35 U.S.C. 154(b) by 0 days.

(21) Appl. No.: 14/142,483

(22) Filed: Dec. 27, 2013

(65) Prior Publication Data

US 2014/0182502 A1 Jul. 3, 2014

Related U.S. Application Data

(60) Provisional application No. 61/746,995, filed on Dec. 28, 2012.

(51) Int. Cl.
*B63B 21/24* (2006.01)
*B63B 35/71* (2006.01)

(52) U.S. Cl.
CPC ..... *B63B 21/243* (2013.01); *B63B 35/71* (2013.01)

(58) Field of Classification Search
CPC ..... B63B 21/243; B63B 35/71
USPC ..... 114/294, 295
See application file for complete search history.

(56) References Cited

U.S. PATENT DOCUMENTS

| | | | | |
|---|---|---|---|---|
| 4,254,730 | A * | 3/1981 | Crenshaw | 114/294 |
| 6,273,016 | B1 * | 8/2001 | Gibbs | 114/230.1 |
| 7,647,878 | B1 * | 1/2010 | Santiago | 114/294 |
| 7,827,927 | B2 * | 11/2010 | Kivi | 114/294 |
| 8,381,671 | B2 * | 2/2013 | Bernloehr et al. | 114/294 |
| 8,495,963 | B2 * | 7/2013 | Bernloehr et al. | 114/230.13 |
| 8,776,712 | B2 * | 7/2014 | Bernloehr et al. | 114/295 |

* cited by examiner

*Primary Examiner* — Daniel V Venne

(57) ABSTRACT

An anchor pin for anchoring small water vessels is provided. The anchor pin includes at least an upper pole and a lower pole that may telescope relative to one another. The upper pole may include a substantially hollow center in which the lower pole may be inserted into. The lower pole may slide within the upper pole and may thereby telescope relative to the upper pole. The lower pole may be locked in a fixed position relative to the upper pole so that the anchor pin may be set at a desired length to anchor the water vessel. The water vessel may be attached to the anchor pin by a rope.

11 Claims, 3 Drawing Sheets

TELESCOPING ANCHOR PIN

CROSS-REFERENCE TO RELATED APPLICATION

This application claims the benefit of priority of U.S. provisional application No. 61/746,995, filed Dec. 28, 2012, the contents of which are herein incorporated by reference.

BACKGROUND OF THE INVENTION

The present invention relates to an anchor pin and, more particularly, to a telescoping anchor pin.

A small water vessel, such as a boat, canoe, kayak and the like, is convenient to use for a recreational fishing trip. Occasionally, it is desirable to keep the small water vessel in one place to fish. However, the wind and current may move the small water vessel and make it difficult for the user to stay in the same place. Anchor pins can be used to anchor the small water vessel. However, anchor pins tend to be large and unwieldy. It is hard to store an 8 ft. to 10 ft. pole.

As can be seen, there is a need for an improved anchor pin for small water vessels.

SUMMARY OF THE INVENTION

In one aspect of the present invention, a telescopic anchor pin comprises: at least an upper pole and a lower pole telescopically connected together; and a cleat protruding laterally from a top end of the upper pole; wherein the upper pole and the lower pole comprise a locked position and a telescoping position relative to one another.

In another aspect of the present invention, a method of anchoring a small water vessel comprises: providing a telescopic anchor pin comprising an substantially hollow upper pole and a lower pole that fits within the substantially hollow upper pole; extending the lower pole from the upper pole; locking the lower pole and the upper pole in a fixed position relative to one another; pushing the lower pole into earth that is below water; and attaching the small water vessel to the upper pole.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an anchor pin for anchoring small water vessels. The anchor pin includes at least an upper pole and a lower pole that may telescope relative to one another. The upper pole may include a substantially hollow center in which the lower pole may be inserted into. The lower pole may slide within the upper pole and may thereby telescope relative to the upper pole. The lower pole may be locked in a fixed position relative to the upper pole so that the anchor pin may be set at a desired length to anchor the water vessel. The water vessel may be attached to the anchor pin by a rope.

The present invention may include an anchor for water vessels, such as kayaks, canoes, row boats, motor boats, and the like. The anchor pin may be telescopic so that the anchor may be extended to a desired length for a particular depth of water. Since the anchor pin is telescopic, the present invention may be easily stored in a rod locker, clipped to the vessel, and may also be used as a push pole. In such embodiments, the present invention may further include a push pole foot.

Figure 1:
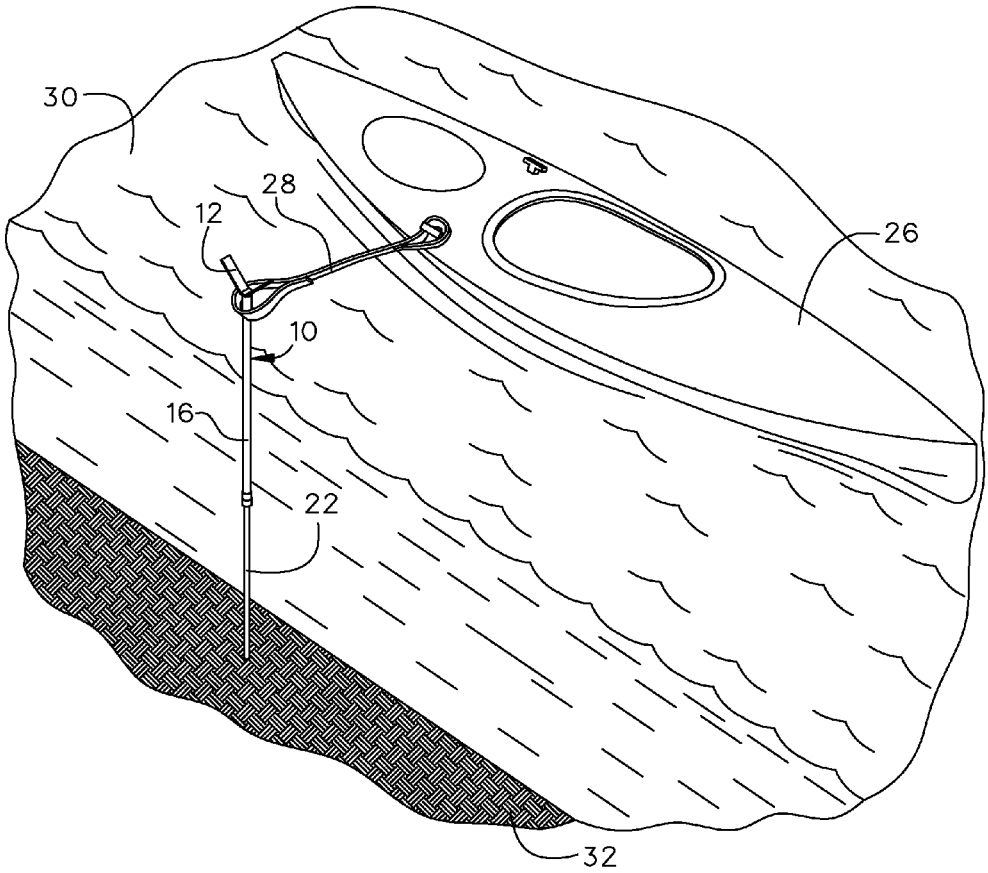
FIG. 1 is a perspective cutaway view of the present invention shown in use.
Figure 2:
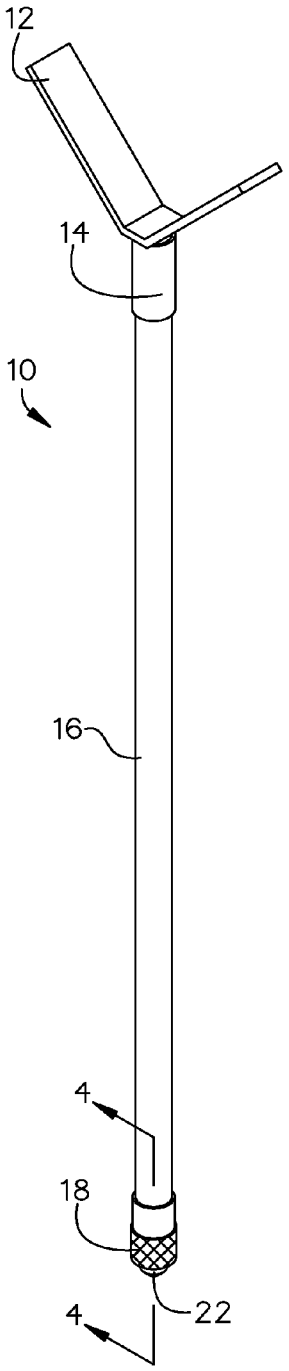
FIG. 2 is a perspective view of the present invention shown in a retracted state.
Figure 3:
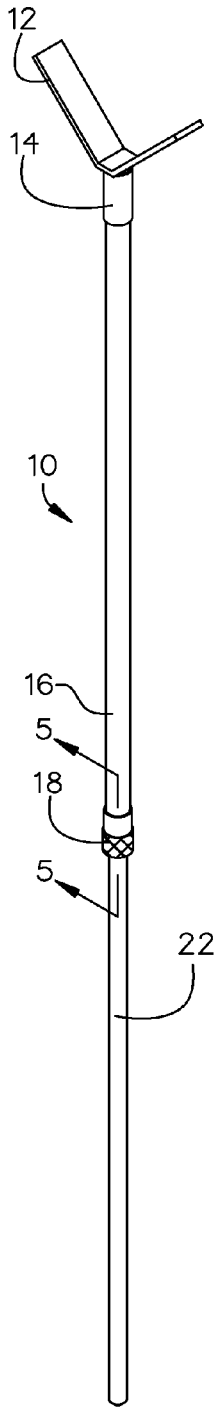
FIG. 3 is a perspective view of the present invention shown in an expanded state.
Figure 4:
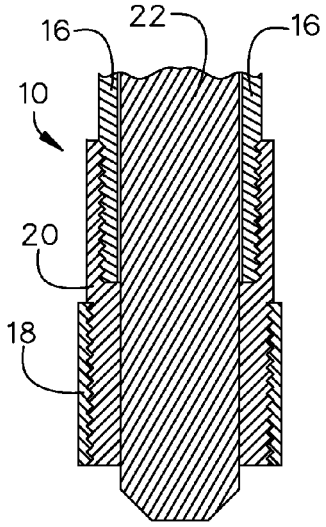
FIG. 4 is a section detail view of the present invention along line 4-4 in FIG. 2.
Figure 5:
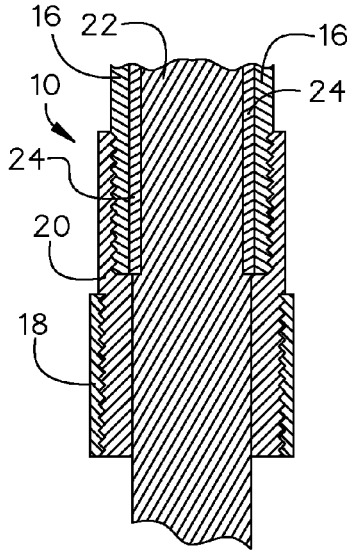
FIG. 5 is a section detail view of the present invention along line 5-5 in FIG. 3.
Figure 6:
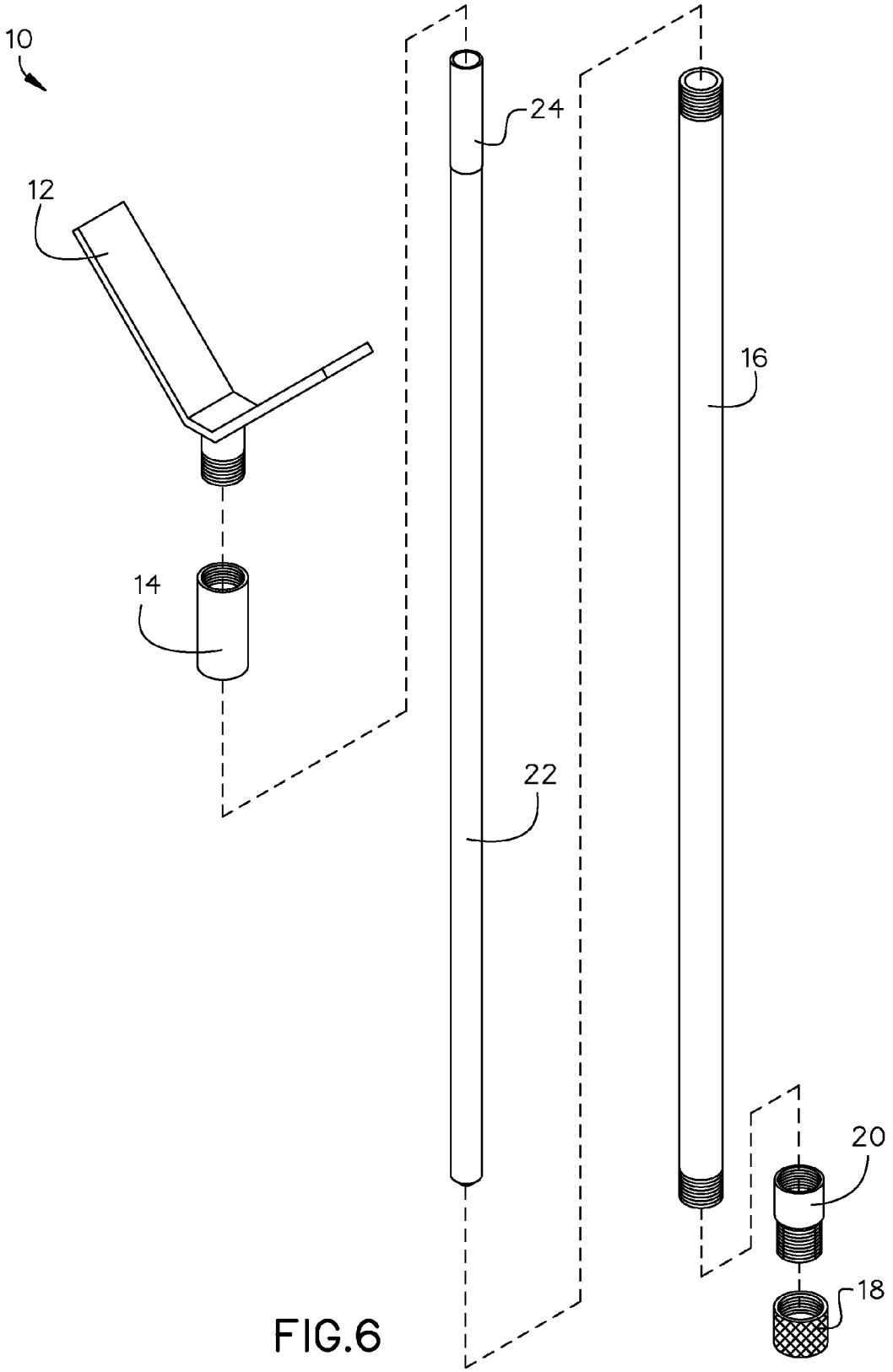
FIG. 6 is an exploded view of the present invention.

Referring to FIGS. 1 through 6, the present invention includes a telescopic anchor pin 10. The telescopic anchor pin 10 may include at least an upper pole 16 and a lower pole 22. The upper pole 16 and the lower pole 22 may be telescopically connected together. The upper pole 16 and the lower pole 22 may include a locked position in which the upper pole 16 and the lower pole 22 cannot move relative to one another. The upper pole 16 and the lower pole 22 may have a telescoping position, in which the upper pole 16 and the lower pole 22 may slide relative to one another. A user may extend the length and lock the telescopic anchor pin 10. The user may push the lower pole 22 through earth 32 that is below the water line 30 and then attach the small water vessel 26 to the upper pole 16.

In certain embodiments, the upper pole 16 may include a substantially hollow center. The upper pole 16 may include a top end and a bottom end. The bottom end may form an opening that leads to the substantially hollow center. The lower pole 22 may slide in and out of the hollow center, thereby telescoping relative to the upper pole 16. In the locked position, the lower pole 22 may be locked within the substantially hollow center and in the telescoping position the lower pole 22 may slide within the upper pole 16. Therefore, the anchor pin 10 may be in a retracted state and in the locked position. A user may unlock the anchor pin 10 to the telescoping position. The user may slide the lower pole 22 out of the upper pole 16 so that the anchor pin 10 may be at a desired length. The user may then again lock the anchor pin 10 into the locked position so that the lower pole 22 and the upper pole 16 are fixed at a desired length.

The present invention may further be broken down into multiple components. In certain embodiments, the present invention may include a pinch bushing 20. The pinch bushing 20 may include an upper female threaded portion and a lower male threaded portion. The upper pole 16 may include a threaded top end and a threaded bottom end. The upper female threaded portion of the pinch bushing may screw onto the bottom end of the upper pole 16.

The present invention may further include a knurled nut 18. The knurled nut 18 may include a female threaded portion and an opening. At least a substantial portion of the lower pole 22 may fit through the opening of the knurled nut 18. The knurled nut 18 may screw onto the lower male threaded portion of the pinch bushing 20. The knurled nut 18 may be tightened onto the pinch bushing 20 or loosened. The tightened position applies pressure to the lower pole 22 thereby locking the lower pole 22 into place relative to the upper pole 16. The loosened position releases pressure to the lower pole 22 allowing the lower pole 22 and the upper pole 16 to telescope relative to one another. In certain embodiments, a sleeve 24 may be attached near the top end of the lower pole 22. The sleeve 24 may have a greater diameter than the opening of the knurled nut 18, thereby preventing the lower pole 22 from completely sliding out of the upper pole 16.

In certain embodiments, the telescopic anchor pin 10 may further include a cleat 12. Therefore, a user may hook a rope 28 around the cleat 12 and attach the rope 28 to a cleat on the small water vessel 26. In certain embodiments, the cleat 12 may be a forked cleat and may protrude laterally from the top end of the upper pole 16. Therefore, the rope 28 may be fixed to the cleat 12. The cleat 12 may be removably attachable to the top end of the upper pole 16. A collar 14 having a female threaded portion within its hollow body may connect the threaded top end of the upper pole 16 to the threaded bottom end of the cleat 12.

A method of anchoring a small water vessel may include the following: providing a telescopic anchor pin comprising an substantially hollow upper pole and a lower pole that fits within the substantially hollow upper pole; extending the lower pole from the upper pole; locking the lower pole and the upper pole in a fixed position relative to one another; pushing the lower pole into earth that is below water; and attaching the small water vessel to the upper pole. The method may further include attaching a rope to a cleat that is attached to a top of the upper pole, and attaching the rope to a cleat that is attached to the small water vessel.

It should be understood, of course, that the foregoing relates to exemplary embodiments of the invention and that modifications may be made without departing from the spirit and scope of the invention as set forth in the following claims.

What is claimed is:

1. A telescopic anchor pin comprising:

at least an upper pole having a substantially hollow center and a bottom end having a threaded portion and an opening leading into the substantially hollow center, a pinch bushing having a first threaded portion at an upper end and a second threaded portion at a lower end, wherein the first threaded portion is connected to the threaded portion of the upper pole, a knurled nut having an upper opening, a lower opening, and threads, wherein the threads are connected to the second threaded portion of the bushing;

a lower pole comprising a top end and a bottom end, wherein the top end comprises a sleeve having a larger diameter than the lower opening of the knurled nut and at least a substantial portion of the lower pole fits through the lower opening of the knurled nut;

a cleat protruding laterally from a top end of the upper pole;

wherein the lower pole and sleeve telescopically received through the opening leading into the substantially hollow center, and the knurled nut is selectively movable between a locked condition, in which the upper pole and the lower pole are maintained in a fixed position relative to one another, and a telescoping condition, in which the upper pole and the lower pole are telescopically movable relative to one another.

2. The telescopic anchor pin of claim 1, further comprising:

the knurled nut comprising female threads, wherein the second threaded portion of the pinch bushing comprises a male threaded portion, wherein the knurled nut is screwed onto the male threaded portion of the pinch bushing.

3. The telescopic anchor pin of claim 1, wherein the bottom end of the lower pole comprises a tapered end.

4. The telescopic anchor pin of claim 1, wherein the cleat is forked.

5. The telescopic anchor pin of claim 1, further comprising a collar comprising an upper female threaded portion and a lower female threaded portion, wherein the collar releasably attaches the cleat and the upper pole together.

6. A method of anchoring a water vessel comprising:

providing a telescopic anchor pin comprising an substantially hollow upper pole and a lower pole, having a sleeve at a top end of the lower pole that fits within the substantially hollow upper pole;

extending the lower pole from the upper pole, wherein a knurled nut, threadingly secured at a lower end of the upper pole, has a lower opening with a diameter less than that of the sleeve, such that the lower pole is captively received within the upper pole;

locking the lower pole and the upper pole in a fixed position relative to one another;

pushing the lower pole into earth that is below water; and attaching the water vessel to the upper pole.

7. The method of claim 6, further comprising attaching a rope to a cleat that is attached to a top of the upper pole, and attaching the rope to a cleat that is attached to the water vessel.

8. A telescopic anchor pin comprising:

an upper pole having a top end, a bottom end, and a substantially hollow center, wherein the bottom end comprises a male threaded portion and an opening leading into the substantially hollow center;

a cleat protruding laterally from the top end of the upper pole;

a knurled nut comprising an opening and a female threaded portion; and a lower pole having a top end and a bottom end, the top end comprises a sleeve having a larger diameter than the opening of the knurled nut, wherein the sleeve and substantial portion of the lower pole are slidably received in the substantially hollow center of the upper pole;

wherein the knurled nut is engageable onto the male threaded portion between a locked position, that applies pressure to the lower pole locking the lower pole relative to the upper pole, and a loosened position that releases pressure to the lower pole allowing the lower pole and the upper pole to telescope relative to one another.

9. The telescopic anchor pin of claim 8, wherein the bottom end of the lower pole comprises a tapered end.

10. The telescopic anchor pin of claim 8, wherein the cleat is forked.

11. The telescopic anchor pin of claim 8, further comprising a collar comprising an upper female threaded portion and a lower female threaded portion, wherein the collar releasably attaches the cleat and the upper pole together.

* * * * *